US010519025B2

(12) United States Patent
Sakthivel et al.

(10) Patent No.: US 10,519,025 B2
(45) Date of Patent: Dec. 31, 2019

(54) ADJUSTABLE LIQUID LEVEL AUTOFILL PITCHER FOR AN APPLIANCE

(71) Applicant: Haier US Appliance Solutions, Inc., Wilmington, DE (US)

(72) Inventors: Dhinesh Babu Sakthivel, Hyderabad (IN); Aditya Kampalli, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 353 days.

(21) Appl. No.: 15/376,727

(22) Filed: Dec. 13, 2016

(65) Prior Publication Data

US 2018/0162713 A1 Jun. 14, 2018

(51) Int. Cl.

| | |
|---|---|
| ***B67D 1/12*** | (2006.01) |
| ***B67D 1/00*** | (2006.01) |
| ***B67D 1/08*** | (2006.01) |
| ***F25D 23/12*** | (2006.01) |
| ***F25D 23/02*** | (2006.01) |

(52) U.S. Cl.

CPC ..... *B67D 1/124* (2013.01); *B67D 1/0003* (2013.01); *B67D 1/0894* (2013.01); *B67D 1/1238* (2013.01); *F25D 23/028* (2013.01); *F25D 23/126* (2013.01); *B67D 1/0888* (2013.01); *B67D 2210/00036* (2013.01); *F25D 2700/06* (2013.01)

(58) Field of Classification Search

CPC .... B67D 1/0008; B67D 1/002; B67D 1/0013; B67D 1/0026; B67D 1/124; B67D 1/1225; B67D 1/46; G03G 23/01

USPC ..... 141/83, 266, 276, 283, 198–229; 210/113; 177/230, 232, 260; 248/575–578

See application file for complete search history.

(56) References Cited

U.S. PATENT DOCUMENTS

| | | | | |
|---|---|---|---|---|
| 4,198,092 | A * | 4/1980 | Federspiel | B60K 28/04 248/575 |
| 4,745,852 | A * | 5/1988 | Sager | A47J 31/402 99/280 |
| 8,056,468 | B2 * | 11/2011 | De'Longhi | A47J 31/007 141/198 |
| 8,377,292 | B2 | 2/2013 | Patera et al. | |
| 2015/0168206 | A1 * | 6/2015 | Ruby | G01G 19/12 177/136 |
| 2016/0015911 | A1 * | 1/2016 | Bazargan | A61M 5/142 137/551 |
| 2016/0271892 | A1 * | 9/2016 | Eckhardt | B60S 5/04 |

FOREIGN PATENT DOCUMENTS

| | | | | |
|---|---|---|---|---|
| CN | 202739733 | U | 2/2013 | |
| WO | WO-2015083362 | A2 * | 6/2015 | B29C 73/166 |

* cited by examiner

*Primary Examiner* — Marina A Tietjen
*Assistant Examiner* — Paul J Gray
(74) *Attorney, Agent, or Firm* — Dority & Manning, P.A.

(57) ABSTRACT

An autofill system for a container where the liquid fill level is adjustable. A proximity sensor is used in conjunction with an adjustable displacement caused by the weight of the liquid to provide for an autofill system with a user selectable liquid fill level.

16 Claims, 7 Drawing Sheets

ADJUSTABLE LIQUID LEVEL AUTOFILL PITCHER FOR AN APPLIANCE

FIELD OF THE INVENTION

The subject matter of the present disclosure relates generally to autofill dispensing system that can automatically fill a container with a liquid to a level that is selectively adjustable.

BACKGROUND OF THE INVENTION

Certain refrigerator appliances include autofill dispensing systems for dispensing water and/or other liquids automatically into a container or receptacle. Autofill dispensing system allow users to place a container, such as a pitcher, into a refrigerator appliance's designated autofill dispensing area such that the container can be filled with liquid automatically. In this manner, autofill dispensing systems provide convenience to users.

Conventional autofill containers have fixed liquid fill levels. Meaning, when a container is placed into an autofill dispensing area and filled with liquid, the container is filled to about the same level each time. Certain conventional autofill containers have used a float mechanism encased within the container to determine when a liquid fill level has been obtained. The float mechanism includes a floating switch. When the float mechanism is displaced upward as the water level rises during filling, the floating switch indicates that the liquid fill level has been obtained and the autofill dispenser ceases dispensing liquid into the container. The liquid fill level, however, is typically not adjustable for this type of autofill container. Accordingly, users are unable to adjust the liquid fill level to fit their individual needs.

Attempts at providing adjustment for the liquid fill level include systems that utilize liquid level sensors. However, typical liquid level sensors, such as infrared sensors, still require the use of a float mechanism encased within the container. Float mechanisms undesirably occupy space within the container. Other sensor types, such as liquid flow rate sensors in combination with time sensors, may be unreliable in that they cannot sense the amount of liquid in the container when it is placed in the dispensing area. Consequently, additional sensors are required.

Therefore, an improved autofill dispensing system is needed. In particular, an autofill system capable of adjusting the liquid fill level of a container is desirable.

BRIEF DESCRIPTION OF THE INVENTION

The present invention provides an autofill system for a container where the liquid fill level is adjustable is provided. In a general aspect, a proximity sensor is used in conjunction with an adjustable displacement caused by the weight of the liquid to provide for an autofill system with a user selectable liquid fill level. Additional aspects and advantages of the invention will be set forth in part in the following description, or may be obvious from the description, or may be learned through practice of the invention.

One exemplary aspect of the present disclosure is directed to an autofill system for automatically dispensing a liquid to an adjustable fill level. The system includes a container defining a vertical direction. The container has a container wall connected with a container bottom that define a volume for holding the liquid. A base unit is attached to or integral with the container bottom. The base unit includes a housing having sidewalls and a recessed wall located at a fixed position relative to the sidewalls, the sidewalls and recessed wall together define a recess. The recessed wall defines an opening. The base unit also includes a spring adjuster received within the opening and adjustable along the vertical direction. The base unit further includes a spring oriented substantially along the vertical direction and has a top end and a bottom end. The top end is coupled to the container bottom and the bottom end is coupled to the spring adjuster. The spring is compressed by an amount depending upon a weight of the liquid in the container. The autofill system also includes a dispensing system having a dispenser capable of dispensing the liquid into the container. The dispensing system also includes a sensor having a proximity range R1 extending outwardly from the sensor. Moreover, a proximity element is integral with or positioned on the container and is detectable by the sensor such that when the proximity element is at or within the proximity range R1 of the sensor, the dispensing system dispenses liquid into the container; and when the proximity element is positioned at a distance greater than the proximity range R1 of the sensor, the dispenser does not dispense liquid into the container.

In another exemplary aspect, when the proximity element is within proximity range of the sensor, the dispensing system can optionally operate on a time delay before dispensing liquid into the container.

In yet another exemplary aspect, the proximity element is optionally a magnet and the sensor is optionally a magnetoresistance sensor.

In yet another exemplary aspect, the proximity element is optionally a photoemitter and the sensor is optionally a photodiode.

In yet another exemplary aspect, the base unit optionally includes a circumferential sidewall extending outwardly from the recessed wall in the vertical direction and further defining the opening. The circumferential sidewall has a threaded portion along an inner surface of the circumferential sidewall. In addition, the spring adjuster has a threaded adjuster portion in threaded engagement with the threaded portion of the circumferential sidewall. The liquid fill level is adjustable by rotating the spring adjuster to tension the spring.

In another exemplary aspect, the spring adjuster optionally has adjuster sidewalls and an adjuster bottom together defining a cavity. And the bottom end of the spring is coupled to the spring adjuster by being seated on the adjuster bottom and received within the cavity.

Another exemplary aspect of the present disclosure is directed to an autofill system for automatically dispensing a liquid to an adjustable fill level. The system includes a container defining a vertical direction. The container has a container wall connected with a container bottom that define a volume for holding the liquid. A base unit is attached to or integral with the container bottom. The base unit includes a housing having sidewalls and a recessed wall located at a fixed position relative to the sidewalls, the sidewalls and recessed wall together defining a recess. The base unit also includes a movable plate received within the recess and movable along the vertical direction. The container is supported upon the movable plate and movable within the recess along with the movable plate. The base unit further includes a spring adjuster coupled to the recessed wall of the housing. The base unit additionally includes a spring having a top end and a bottom end, the top end is coupled to the moveable plate and the bottom end is coupled to the spring adjuster. The spring is compressed by an amount depending upon a weight of the liquid in the container. The spring adjuster is configured to selectively determine an amount of force applied by the spring against the movable plate corresponding to a desired liquid fill level. The autofill system also includes a dispensing system having a dispenser capable of dispensing the liquid into the container. The dispensing system includes a sensor having a proximity range R1 extending outwardly from the sensor. Moreover, a proximity element is integral with or positioned on the container and is detectable by the sensor such that when the proximity element is at or within the proximity range R1 of the sensor, the dispensing system dispenses liquid into the container; and when the proximity element is positioned at a distance greater than the proximity range R1 of the sensor, the dispenser does not dispense liquid into the container.

In another exemplary aspect, when the proximity element is within proximity range of the sensor, the dispensing system can optionally operate on a time delay before dispensing liquid into the container.

In yet another exemplary aspect, the proximity element is optionally a magnet and the sensor is optionally a magnetoresistance sensor.

In yet another exemplary aspect, the proximity element is optionally a photoemitter and the sensor is optionally a photodiode.

In another exemplary aspect, the top end of the spring is optionally coupled to the moveable plate by a circumferential spring guide extending outwardly from the moveable plate in the vertical direction.

Variations and modifications can be made to these exemplary aspects of the present disclosure.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
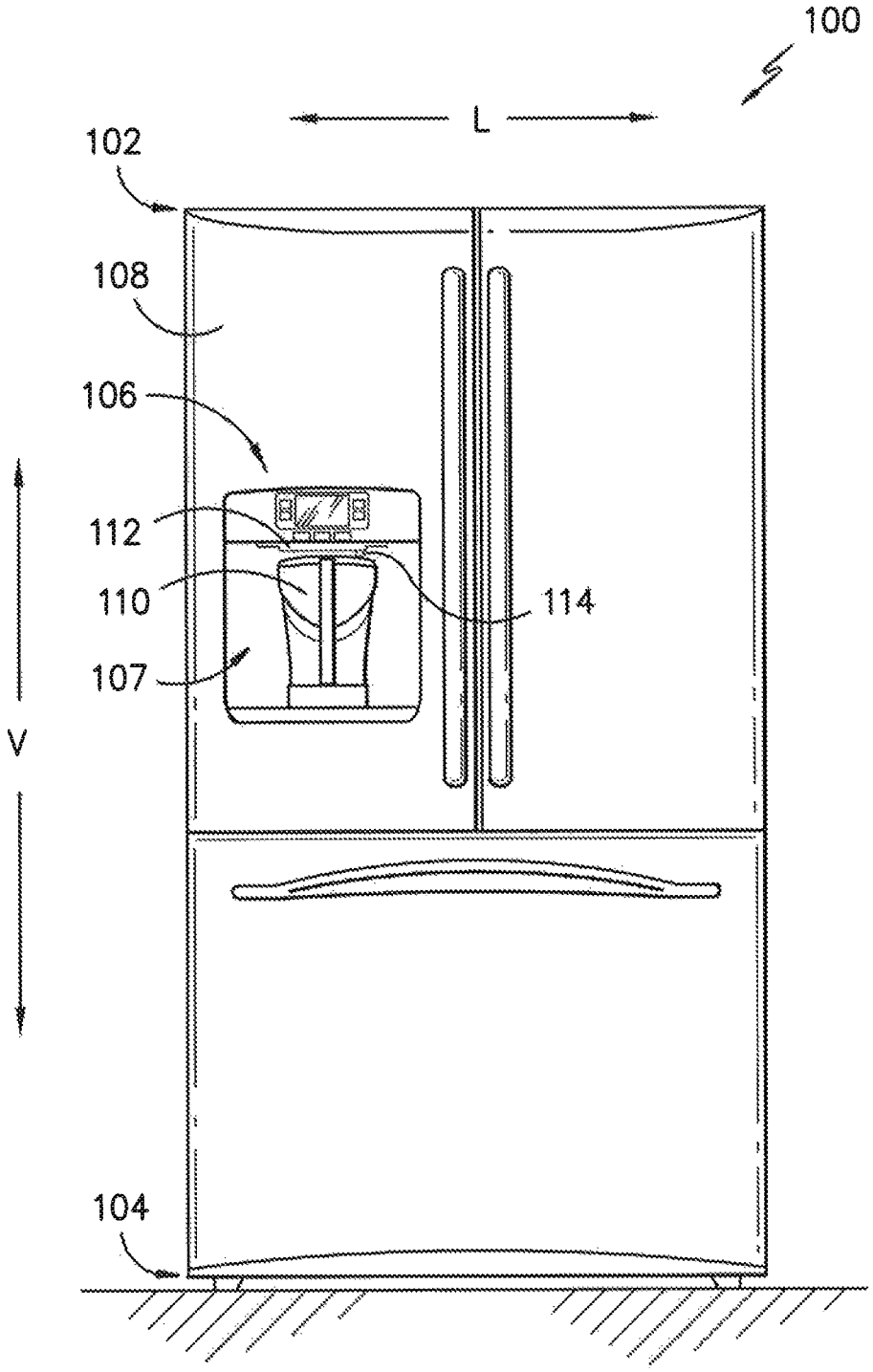
FIG. 1 is a front, elevation view of an exemplary refrigerator appliance having an autofill dispensing system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a front, elevation view of an exemplary refrigerator appliance 100 according to an exemplary embodiment of the present disclosure. Refrigerator appliance 100 defines a vertical direction V that extends between an upper refrigerator portion 102 and a lower refrigerator portion 104, and a lateral direction L extends between the sides of refrigerator appliance 100 and orthogonal to vertical direction V.

Refrigerator appliance 100 includes an autofill dispensing system 106 for dispensing liquids and is positioned on or mounted on a door 108 of refrigerator appliance 100. Other mounting positions are also contemplated. Dispensing system 106 is configured to fill a container 110 with a volume of liquid automatically when container 110 is placed within an autofill recess 107 of dispensing system 106. In alternative embodiments, dispensing system 106 may be located within the interior of refrigerator appliance 100. In this manner, container 110, such as an autofill pitcher, may be filled with liquid automatically and kept chilled within refrigerator appliance 100.

Figure 8:
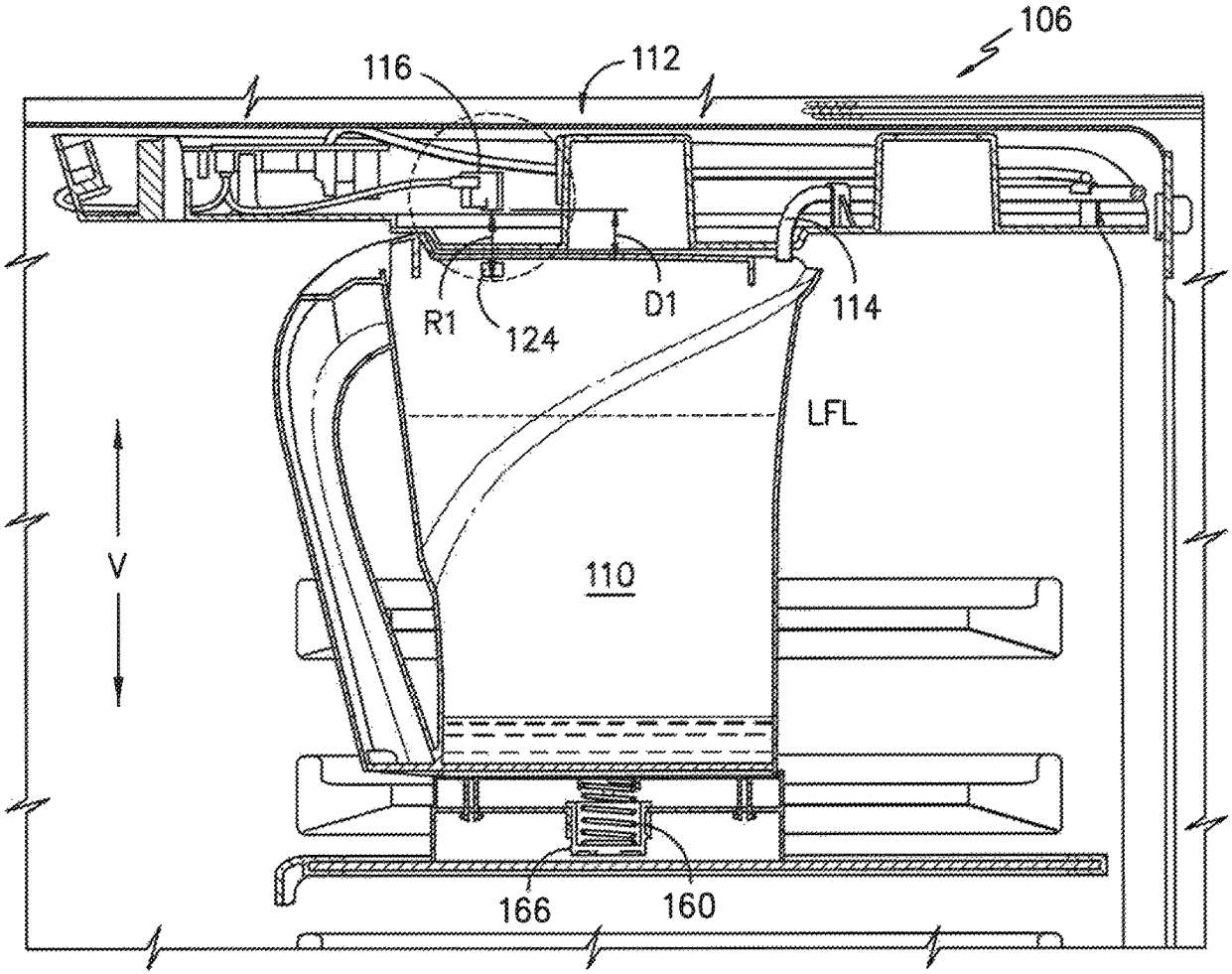
FIG. 8 shows an exemplary container placed within a dispensing area of an exemplary dispensing system.

Dispensing system 106 includes an autofill housing 112 that includes a dispenser 114, water lines (not shown), and may include other items such as a light and/or other electrical components (not shown), for example. Moreover, autofill housing 112 includes a sensor 116 (FIG. 8). Sensor 116 can be a magnetoresistance sensor, for example.

It will be appreciated that the present subject matter can be used with other types of refrigerator appliances (e.g., side-by-side, top mount); a freezer appliance; or other types of appliances as well. Further, the present disclosure can be applied to dispensing systems outside the context of home appliances, such as commercial or office liquid dispensing systems. Consequently, the description of refrigerator appliance 100 set forth herein is for illustrative purposes only and is not intended to limit the present subject matter in any aspect.

Figure 2:
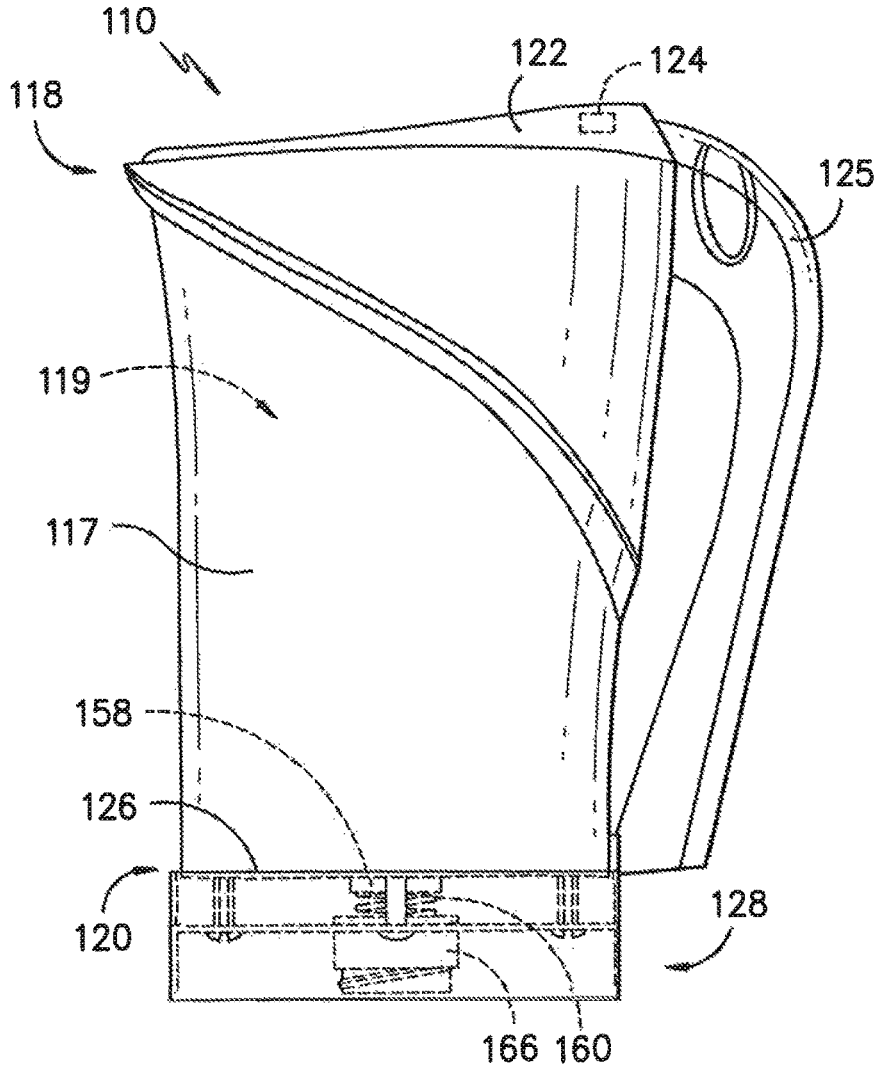
FIG. 2 is a side, elevation view of an exemplary autofill container.
Figure 3:
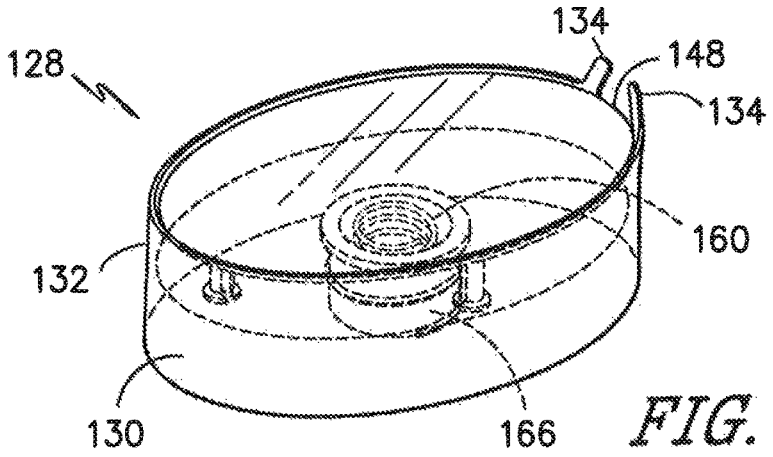
FIG. 3 is a perspective view of a fully assembled exemplary base unit.

FIG. 2 provides a side view of exemplary container 110. Container 110 includes a container wall 117 connected with a container bottom 126 that together define a volume 119 capable of holding a liquid. Container wall 117 of container 110 extends vertically between a top end 118 and a bottom end 120 of container 110. Top end 118 includes a lid 122 that permits a user to pour liquid into another container and acts as a seal to contain the liquid within container 110. Lid 122 also includes an aperture (not shown) that may be aligned with dispenser 114 of the dispensing system 106 such that container 110 may be filled with liquid. Other shapes and sizes for container 110 may be used as FIG. 2 is provided by way of example only.

Lid 122 includes a proximity element 124 integral with or positioned on lid 122. In other embodiments, proximity element 124 may be integral with or positioned on container 110 in other areas. For example, proximity element 124 may be integral with a handle 125 or located near bottom end 120 of container 110. In this exemplary embodiment, proximity element 124 is a magnet. Nevertheless, proximity element 124 may include other constructions or configurations capable of being detected by sensor 116 (FIG. 8).

Referring still to FIG. 2, bottom end 120 of container 110 includes a base unit 128 (shown transparent in FIG. 2), which may be selectively attachable to container bottom 126 as shown in FIG. 2 or may be, in other embodiments, formed integrally with bottom end 120 of container 110. In some embodiments, base unit 128 may advantageously be attached to a user's existing autofill container or may allow a user to attach base unit 128 to different containers of various sizes and/or shapes, providing convenience to the user. Where base unit 128 is permanently fixed to container 110, manufacturing advantages may be realized, among other benefits.

Figure 4:
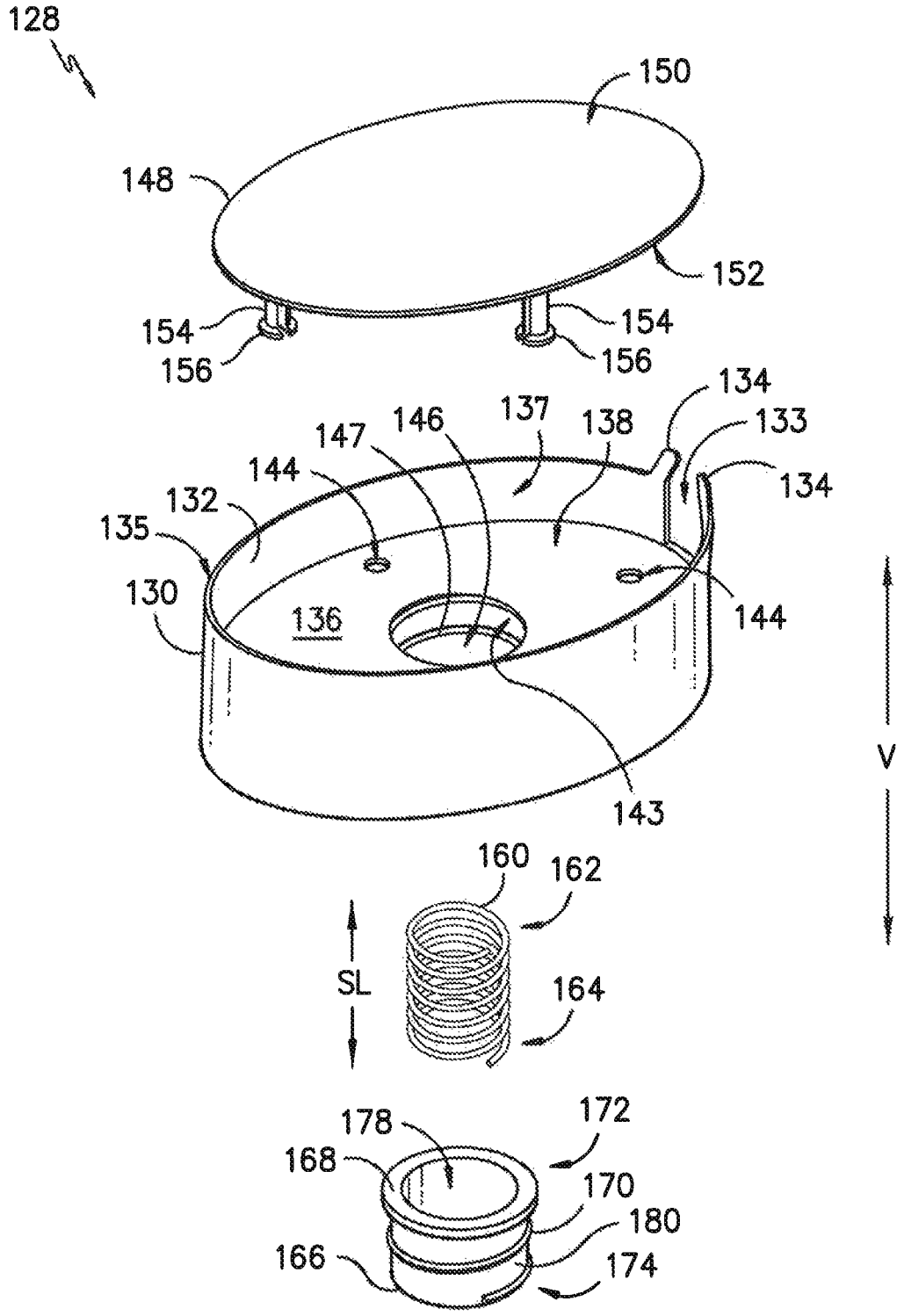
FIG. 4 is an exploded view of the base unit of FIG. 3.
Figure 5:
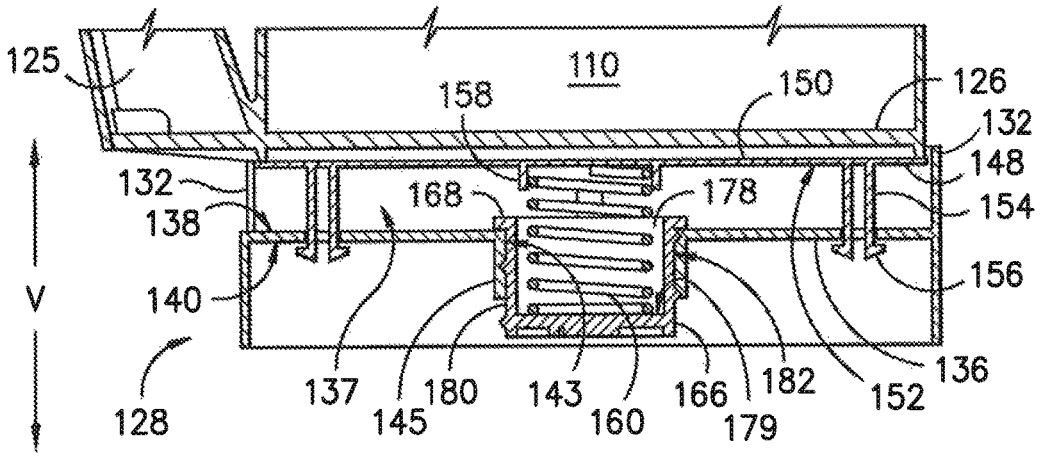
FIG. 5 is a cross-sectional view of an exemplary base unit with a spring of the base unit shown in an extended position.
Figure 6:
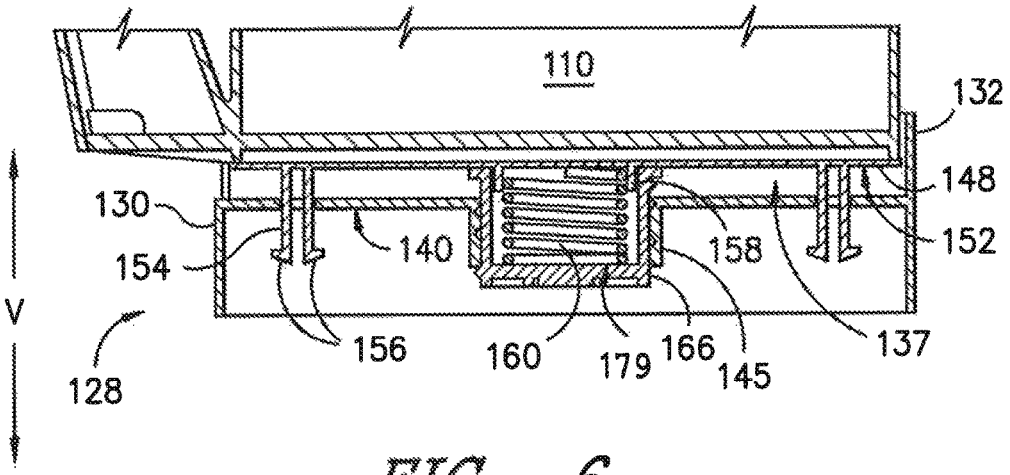
FIG. 6 is a cross-sectional view of an exemplary base unit with a spring of the base unit shown in a compressed position.

Referring now to FIGS. 3-6, FIG. 3 provides a perspective view of an exemplary base unit 128 (shown transparent for illustration purposes in FIG. 3) and FIG. 4 provides an exploded view thereof. FIG. 5 provides a cross-sectional view of base unit 128 with a spring 160 in an extended state or position, while FIG. 6 shows a cross-sectional view of base unit 128 with spring 160 in a compressed state or position. For this embodiment, base unit 128 includes a housing 130, a moveable plate 148, spring 160, and a spring adjuster 166.

Housing 130 includes sidewalls 132 that extend along vertical direction V and around the perimeter of base unit 128. Sidewalls 132 define a gap 133 (FIG. 4) that is positioned so that handle 125 of container 110 does not impede the movement of container 110 up and down along vertical direction V. Gap 133 is not necessary if, for example, container 110 does not include handle 125.

For this embodiment, housing 130 includes snap hooks 134 extending from sidewalls 132 that act to retain base unit 128 with container 110. Snap hooks 134 extend upwardly and inwardly over gap 133. Handle 125 is configured to slide between snap hooks 134 such that the snap hooks 134 are wedged around a portion of handle 125 while still allowing container 110 to move along vertical direction V while handle 125 slides or moves within gap 133. Other means may also be used to attach base unit 128 to container 110, such as by use of a latch or snap-fit connector, for example.

Housing 130 also includes a recessed wall 136 having a top surface 138 and a bottom surface 140. Recessed wall 136 lies in a horizontal plane orthogonal to vertical direction V and is located at a fixed position relative to sidewalls 132 and vertically below moveable plate 148. In this way, recessed wall 136 and sidewalls 132 of housing 130 together define a recess 137 into which plate 148 and container 110 are movably received. When liquid is filled into container 110, recess 137 receives container 110 to allow container 110 to be moveable in vertical direction V. Similarly, as moveable plate 148 supports container 110, moveable plate 148 is also moveable within recess 137.

Fixed and recessed wall 136 defines a plurality of apertures 144 arranged about an opening 146 and spaced apart from one another. Apertures 144 are each configured to slidably receive a corresponding snap post 154 as will be described below. In this embodiment, there are four apertures 144 disposed circumferentially about opening 146 corresponding to four snap posts 154. However, in other embodiments, there may be more than four or less than four apertures 144.

Opening 146 is defined by recessed wall 136 and a circumferential sidewall 145 (FIGS. 5 and 6). Specifically, in this embodiment, circumferential sidewall 145 circumferentially defines opening 146 along the vertical direction V. Circumferential sidewall 145 extends outwardly from recessed wall 136 in a downward vertical direction V. The inner surface 143 (FIG. 4) of circumferential sidewall 145 has a threaded portion 147 that receives threaded adjuster portion 170 (FIG. 4) of spring adjuster 166. The threaded engagement between threaded portion 147 and threaded adjuster portion 170 allows for spring adjuster 166 to adjust the compression of spring 160. In particular, rotating spring adjuster 166 causes spring adjuster 166 to move along vertical direction V to either increase or decrease the compression of spring 160. More particularly, if spring adjuster 166 is moved upward along vertical direction V, the compression of spring 160 is increased. Conversely, if spring adjuster 166 is moved downward along vertical direction V, the compression of spring 160 is decreased.

Moveable plate 148 has a top surface 150 and a bottom surface 152. Top surface 150 is positioned in contact with container bottom 126 or at least a portion of the container bottom 126 and has a shape generally complementary to container bottom 126. Snap posts 154 extend outwardly and vertically downward from bottom surface 152. Each snap post 154 includes stops 156, which extend outwardly along lateral direction L from each post 154. Each snap post 154 is configured to extend through a corresponding aperture 144 of housing 130, and once inserted, the stops 156 of each snap post 154 may catch on bottom surface 140 of recessed wall 136 when spring 160 is in an extended position (i.e., a non-compressed or practically non-compressed state) as shown in FIG. 5. In this manner, snap posts 154 assist in ensuring that when container 110 is not filled with a volume of liquid and spring 160 is in an extended position, moveable plate 148 remains substantially level and is not pushed completely out of recess 137 by spring 160. Snap posts 154 also assist in guiding the sliding movement of container 110 and plate 148 downward as liquid is dispensed into container 110 or upward as the weight of container 110 decreases as liquid is dispensed therefrom.

Additionally, as detailed in FIGS. 5 and 6, bottom surface 152 of movable plate 148 includes a circumferential spring guide 158 that extends outwardly and downwardly along vertical direction V from bottom surface 152. Circumferential spring guide 158 receives a top end 162 of spring 160. In this manner, as container 110 is moved substantially along vertical direction V when liquid is poured into container 110, circumferential spring guide 158 prevents spring 160 from slipping along lateral direction L. For example, liquid may be poured from a single dispenser into container 110 and the dispenser may pour liquid on one side or the other of container 110, causing an unbalanced load on spring 160. Circumferential spring guide 158 prevents lateral slippage of spring 160 as noted above. In one embodiment, spring 160 may be further secured to bottom surface 152 by other or additional means, such as by an adhesive.

In another exemplary embodiment, although not shown, moveable plate 148 is not included in base unit 128. In this embodiment, snap posts 154 and circumferential spring guide 158 extend outwardly and in the downward vertical direction V from container bottom 126 in the same manner as shown and described with respect to the embodiment noted above that includes moveable plate 148. Other means can be provided for containing moveable plate 148 within recess 137 such as e.g., a lip along the top edge 135 of sidewalls 132 (FIG. 4).

Spring 160 is positioned under container 110 and its spring length SL is oriented substantially along vertical direction V (spring length SL means the spring length regardless of whether spring 160 is compressed or elongated). Specifically, spring 160 extends through opening 146 to be compressed between an adjuster bottom 179 (FIGS. 5 and 6) of spring adjuster 166 and bottom surface 152 of moveable plate 148 (or alternatively, container bottom 126). In this way, spring 160 may control the movement or adjustment of container 110 as it is displaced downward into recess 137 of base unit 128. Spring 160 may be made of any suitable material, such as chrome vanadium steel.

More specifically, in this exemplary embodiment, spring 160 is coupled in the following manner. A bottom end 164 of spring 160 is received within a cavity 178 of spring adjuster 166 and is seated along an adjuster bottom 179. Top end 162 of spring 160, as noted above, is received within circumferential spring guide 158 extending from moveable plate 148. Top end 162 is pressed against bottom surface 152 of moveable plate 148 as detailed in FIG. 5. In an alternative embodiment, top end 162 of spring 160 is received within circumferential spring guide 158 extending from container bottom 126. Specifically, top end 162 may be pressed up against container bottom 126. In another embodiment, circumferential spring guide 158 is optionally not included and top end 162 of spring 160 is adhered to moveable plate 148 or container bottom 126. In another embodiment, top end 162 of spring 160 is adhered to moveable plate 148 or container bottom 126 and received within circumferential spring guide 158.

In FIG. 5, spring 160 is shown in an extended position, as container 110 does not include liquid or contains a negligible amount. The stops 156 of snap posts 154 are catching or almost catching on bottom surface 140 of recessed wall 136 to prevent further vertical movement upward of plate 148 and container 110. The moveable plate 148 and container 110 are only displaced within recess 137 slightly. As container 110 is filled with liquid, the weight of the liquid causes spring 160 to compress, moving container 110 downward along vertical direction V. As a result and as shown in FIG. 6, spring 160 is shown in a compressed position, as container 110 is filled at least in part with liquid. Spring 160 is shown compressed such that the entire spring length SL is disposed within cavity 178 of spring adjuster 166. Likewise, circumferential spring guide 158 of moveable plate 148 is disposed within cavity 178 of spring adjuster 166. Additionally, container 110 has been displaced further into recess 137 of housing 130 and the stops 156 of snap posts 154 have also been displaced away from bottom surface 140 of recessed wall 136.

Spring adjuster 166 is configured to adjust the tension of spring 160 to a predetermined tension. Spring adjuster 166 has an adjuster top portion 172 and an adjuster bottom portion 174. In this embodiment, spring adjuster 166 is a rotatable knob. As noted previously, spring adjuster 166 includes cavity 178 defined by adjuster bottom 179 and adjuster sidewalls 180. Cavity 178 receives spring 160. Specifically, adjuster bottom 179 receives bottom end 164 of spring 160.

In accordance with one aspect of the present disclosure, a user may adjust the liquid fill level LFL (FIG. 8) of container 110 by utilizing spring adjuster 166 to tension spring 160. The more a user pre-compresses spring 160, the more spring 160 will resist the downward movement or displacement of container 110; and conversely, the less a user pre-compresses spring 160, the less spring 160 will resist the downward movement or displacement of container 110. This is based on the principle that a force from a spring (i.e., the spring's restoring force) is proportional to the displacement of the spring from its equilibrium position (i.e., its relaxed state). Thus, in this context, the more a user pre-compresses spring 160, the greater the force required to compress spring 160 further, and consequently, the more weight or volume of liquid that can be filled into container 110 before container 110 is displaced such that proximity element 124 is no longer in a proximity range R1 of sensor 116 (FIG. 8).

Conversely, the less a user pre-compresses or reduces the compression on spring 160, the less spring 160 will resist the downward movement of container 110. Therefore, the less a user pre-compresses spring 160 via spring adjuster 166, the less weight or volume of liquid that may be present in container 110 before container 110 is displaced downward such that proximity element 124 is no longer in proximity range R1 of sensor 116. In short, spring adjuster 166 is configured to selectively determine an amount of force applied by spring 160 against movable plate 148 (or the container bottom 126 in other exemplary embodiments) that corresponds to a desired liquid fill level LFL (FIG. 8).

With specific reference to FIG. 5, a circumferential stop 168 of spring adjuster 166 prevents a user from rotating spring adjuster 166 too far downward such that it comes loose. Circumferential stop 168 extends circumferentially outward in the lateral direction L from the adjuster sidewalls 180 along the adjuster top portion 172. As shown in FIG. 5, circumferential stop 168 may contact top surface 138 of recessed wall 136 for particular liquid fill level settings. Accordingly, a user may not continue rotating spring adjuster 166.

In addition, as noted previously, spring adjuster 166 includes adjuster threaded portion 170 disposed on the outer surface 182 of adjuster sidewall 180. Adjuster threaded portion 170 is configured to be in threaded engagement with threaded portion 147. In this manner, a user may rotate spring adjuster 166 to adjust the tension on spring 160.

Figure 7:
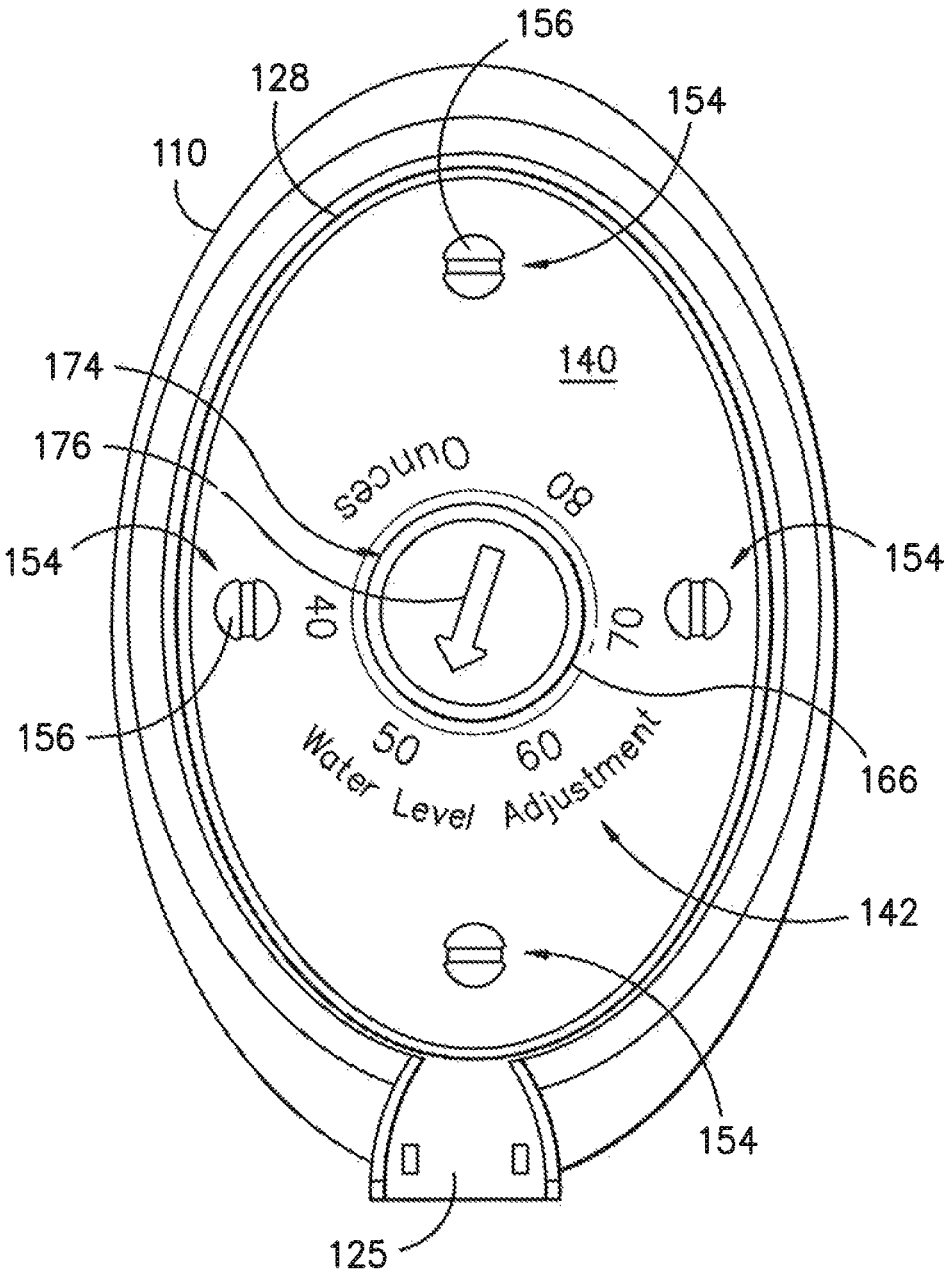
FIG. 7 is a bottom view of a base unit of an exemplary autofill container.

Referring now to FIG. 7, a bottom view of an exemplary base unit 128 of an autofill container 110 is provided. Adjuster bottom portion 174 includes an indicator 176, such as an arrow, that indicates to a user which liquid fill level LFL is selected. A user may readily adjust the liquid fill level LFL by rotating spring adjuster 166 to the desired level indicated by liquid fill level indicia 142. In this exemplary embodiment, the liquid fill level LFL of container 110 ranges between about forty (40) ounces to about eighty (80) ounces of liquid. A user may rotate spring adjuster 166 to select one of the liquid fill level settings. It will be appreciated that other ranges are also possible. The liquid fill indicia 142 correspond to predetermined tension settings of spring 160. For example, forty (40) ounces could correspond with a particular spring pre-compression setting $T_1$, fifty (50) ounces could correspond with a spring pre-compression setting $T_2$, and so on and so forth up to eighty (80) ounces.

FIG. 8 shows an exemplary container 110 placed on an interior shelf of refrigerator appliance 100 and positioned under autofill housing 112. Proximity element 124 activates dispenser 114 of dispensing system 106 to dispense liquid into container 110 by being positioned within proximity range R1 of sensor 116. More specifically, when proximity element 124 is at or within proximity range R1 of sensor 116, dispensing system 106 dispenses liquid into container 110. When proximity element 124 is not at or within proximity range R1 of sensor 116, dispensing system 106 does not dispense liquid into container 110.

The proximity range R1 defines a distance that extends outwardly from sensor 116 as shown in FIG. 8 and in which proximity element 124 is detectable. By way of example, proximity range R1 may extend outwardly from senor 116 about 0.6 to about 1 inch. However, proximity range R1 could be configured to be any desired distance.

A distance D1 defines the distance between sensor 116 and proximity element 124, which changes based on the amount of liquid in container 110. When the proximity range R1 is less than distance D1, dispensing system 106 dispenses liquid into container 110. When the proximity range R1 is greater than distance D1, dispensing system 106 ceases dispensing liquid into container 110. For example, in FIG. 8, proximity range R1 extends further than distance D1. Thus, proximity element 124 would be deemed to be at or within proximity range R1 of sensor 116, and consequently, dispenser 114 dispenses liquid into container 110.

As dispenser 114 dispenses liquid into container 110, the liquid level in container 110 begins to rise. As this occurs, spring 160 begins to compress due to the weight of the liquid within container 110. As spring 160 compresses, container 110 moves substantially along vertical direction V. When proximity element 124 is no longer within proximity range R1 of sensor 116, dispenser 114 ceases dispensing liquid into container 110. The liquid fill level LFL is the amount of liquid in container 110 that provides a load on spring 160 that causes it to compress such that proximity element 124 is no longer at or within proximity range R1 of sensor 116.

In some embodiments, proximity element 124 may constantly provide a signal that is detectable by sensor 116 and e.g., increases in intensity as the distance between proximity elements 124 and sensor 116 decreases. As such, proximity range R1 may be a predetermined minimum level at which sensor 116 can detect a signal from proximity element 124.

In one exemplary embodiment, proximity element 124 is a magnet and sensor 116 is a magnetoresistance sensor in operative communication with a controller in appliance 100 that controls dispensing system 106. For example, magnetoresistance sensor 116 is capable of detecting a predetermined level or amount of magnetic flux. The magnet 124 within lid 122 of container 110 gives off a certain magnetic flux. When magnetoresistance sensor 116 detects a predetermined level or amount of magnetic flux, dispenser 114 of dispensing system 106 dispenses liquid into container 110. On the other hand, when magnetoresistance sensor does not detect a predetermined level or amount of magnetic flux, dispenser 114 of dispensing system 106 ceases or does not dispense liquid into container 110, even where some magnetic flux is detectable by the magnetoresistance sensor. In certain embodiments, the predetermined level or amount of magnetic flux may be adjusted by a user so that various containers having differing size or types of magnets may be used.

In yet another embodiment, sensor 116 could be a photodiode and proximity element 124 could be a photoemitter. The predetermined level could be a predetermined luminous intensity. For example, when the photodiode detects the predetermined level or amount of luminous intensity from photoemitter, the photoemitter would be considered "in range" of the photodiode sensor. If the photodiode sensor does not detect the predetermined level or amount of luminous intensity, the photoemitter would be deemed "out of range" or "out of proximity range R1" of the photodiode even if some amount or magnitude of luminous intensity was detected. Other sensor types may be used as well including e.g., infrared, ultrasonic, and others.

Figure 9:
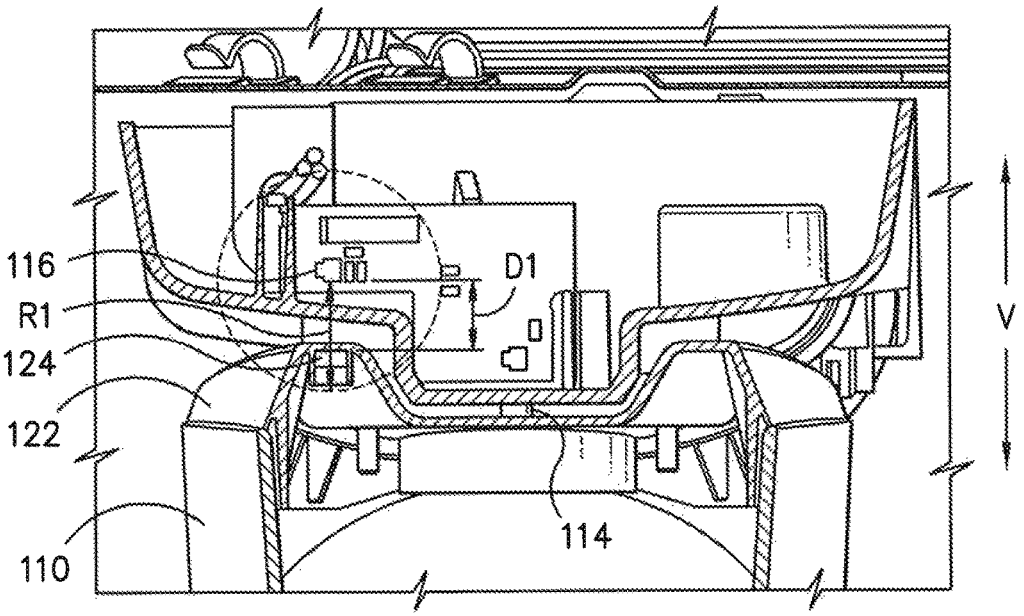
FIG. 9 shows an exemplary container including a proximity element that is at or within proximity range of a sensor of an exemplary dispensing system.

With reference now to FIG. 9, exemplary container 110 is shown placed beneath autofill housing 112 of dispensing system 106. As illustrated, proximity element 124 is positioned at or within proximity range R1 of sensor 116, as proximity range R1 extends a greater distance or further than distance D1. In this example, the distance between proximity element 124 and sensor 116 (i.e., the distance D1) is 0.4 inches (1.016 cm). As proximity range R1 is about 0.7 inches (1.778 cm) in this example, proximity element 124 is at or within the proximity range R1 of sensor 116. Accordingly, dispenser 114 dispenses liquid into container 110.

Continuing with the example, as liquid continues to flow into container 110, spring 160 is compressed and container 110 moves along vertical direction V downward into recess 137 due to the weight of the volume of liquid filling into container 110.

Figure 10:
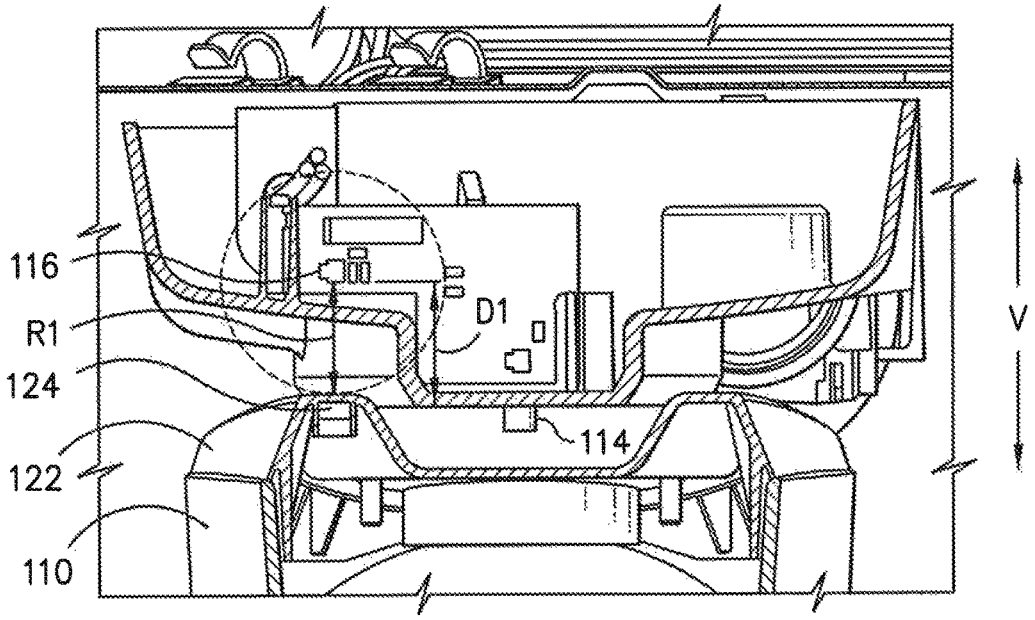
FIG. 10 shows an exemplary container including a proximity element that is not at or within proximity range of a sensor of an exemplary dispensing system.

FIG. 10 shows container 110 of FIG. 9 with proximity element 124 no longer in proximity range R1 of sensor 116. Proximity element 124 is now 0.8 inches (2.032 cm) from sensor 116. As the proximity range R1 in this example is 0.7 inches (1.778 cm), proximity element 124 is no longer in proximity range R1. Here, the weight of the liquid within container 110 has caused spring 160 to compress an amount such that distance D1 is greater than proximity range R1. As a result, dispenser 114 of dispensing system 106 ceases dispensing liquid into container 110 as the designated liquid fill level LFL has been reached/obtained.

It will be appreciated that the proximity range R1 can be adjusted as needed to accommodate certain variables, such as differing spring stiffness, differing magnets, differing sensors, and differing mounting locations of sensor 116 and/or proximity element 124. The proximity range R1 of sensor 116 may be adjusted by a controller (not shown), for example. The controller can be configured to be in operative communication with sensor 116 such that the proximity range R1 of sensor 116 may be adjusted by a user interface located on a control panel of the refrigerator appliance 100 or by a portable electronic device operated by a user.

It will also be appreciated that when container 110 is placed within autofill recess 107 of dispensing system 106 and proximity element 124 is within proximity range R1 of sensor 116, that dispenser 114 may dispense liquid on a time delay to ensure that a user has correctly placed or seated container 110 underneath dispenser 114 such that dispensed liquid actually flows into container 110. The time delay can be controlled by a controller of refrigerator appliance 100 or of dispensing system 106, for example. In addition, other means can be used to ensure that container 110 is correctly placed or seated within autofill recess 107 before dispenser 114 dispenses liquid into container 110. For instance, sensors can be used to ensure that dispenser 114 is properly aligned with an aperture (not shown) in lid 122 of container 110 before dispensing liquid.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An autofill system for automatically dispensing a liquid to an adjustable fill level, comprising:

a container defining a vertical direction and including a container wall connected with a container bottom defining a volume for holding the liquid;

a base unit comprising:

a housing having sidewalls and a recessed wall located at a fixed position relative to the sidewalls, the sidewalls and recessed wall together defining a recess into which the container is movably received, the recessed wall defining an opening;

a spring adjuster received within the opening and adjustable along the vertical direction; and a spring oriented along the vertical direction and having a top end and a bottom end, the top end coupled to the container bottom and the bottom end coupled to the spring adjuster, wherein the spring is compressed by an amount depending upon a weight of the liquid in the container;

a circumferential sidewall extending outwardly from the recessed wall in the vertical direction and further defining the opening, the circumferential sidewall having a threaded portion along an inner surface of the circumferential sidewall;

the spring adjuster having a threaded adjuster portion in threaded engagement with the threaded portion of the circumferential sidewall;

wherein the liquid fill level is adjustable by rotating the spring adjuster to tension the spring;

a dispensing system having a dispenser capable of dispensing the liquid into the container and including a sensor having a proximity range R1, the proximity range R1 extending outwardly from the sensor; and a proximity element integral with or positioned on the container and detectable by the sensor such that when the proximity element is at or within the proximity range R1 of the sensor, the dispensing system dispenses liquid into the container; and when the proximity element is positioned at a distance greater than the proximity range R1 of the sensor, the dispenser does not dispense liquid into the container.

2. The autofill system of claim 1, wherein the proximity element is a magnet and the sensor is a magnetoresistance sensor.

3. The autofill system of claim 1, wherein the proximity element is disposed on or integral with a lid of the container.

4. The autofill system of claim 1, wherein the proximity range R1 extends outwardly from the sensor by 0.6 to 1 inch.

5. The autofill system of claim 1, further comprising:

a movable plate received within the recess and movable along the vertical direction, wherein the container is supported upon the movable plate and movable within the recess along with the movable plate;

wherein the recessed wall has a top surface and a bottom surface and a plurality of apertures disposed about the opening; and wherein a plurality of snap posts each extend outwardly from the movable plate towards the recessed wall each snap post extending through a corresponding aperture in the recessed wall and configured to catch on the bottom surface of the recessed wall when the spring is in an extended position.

6. The autofill system of claim 1, wherein the top end of the spring is coupled to the container bottom by a circumferential spring guide extending outwardly from the container bottom in the vertical direction.

7. The autofill system of claim 1, wherein the recessed wall is oriented orthogonal to the vertical direction.

8. The autofill system of claim 1, wherein the spring adjuster is a rotatable knob configured to rotate such that the liquid fill level of the container is selectable.

9. The autofill system of claim 1, wherein the base unit is attachable to the container at least in part by a snap hook.

10. The autofill system of claim 1, wherein the spring adjuster has adjuster sidewalls and an adjuster bottom together defining a cavity, wherein:

the bottom end of the spring is coupled to the spring adjuster by being seated on the adjuster bottom and received within the cavity.

11. An autofill system for automatically dispensing a liquid to an adjustable fill level, comprising:

a container including a container wall connected with a container bottom and defining a volume for holding a liquid;

a base unit comprising a housing having sidewalls and a recessed wall located at a fixed position relative to the sidewalls, the sidewalls and recessed wall together defining a recess into which the container is movably received; wherein the recessed wall defines an opening and has a top surface and a bottom surface, a plurality of apertures disposed about the opening;

a movable plate received within the recess and movable along the vertical direction, wherein the container is supported upon the movable plate and movable within the recess along with the movable plate, a spring adjuster coupled to the recessed wall of the housing;

a spring having a top end and a bottom end, the top end coupled to the moveable plate and the bottom end coupled to the spring adjuster, wherein the spring is compressed by an amount depending upon a weight of the liquid in the container; and wherein the spring adjuster is configured to selectively determine an amount of force applied by the spring against the movable plate corresponding to a desired liquid fill level;

a plurality of snap posts each extending outwardly from the moveable plate, each snap post extending through a corresponding aperture and configured to catch on the bottom surface when the spring is in an extended position;

a dispensing system capable of dispensing the liquid into the container and comprising a sensor having a proximity range R1, the proximity range R1 extending outwardly from the sensor;

a proximity element integral with or positioned on the container and detectable by the sensor such that when the proximity element is at or within the proximity range R1 of the sensor, the dispensing system dispenses liquid into the container; and when the proximity element is positioned at a distance greater than the proximity range R1 of the sensor, the dispenser does not dispense liquid into the container.

12. The autofill system of claim 11, wherein the top end of the spring is coupled to the moveable plate by a circumferential spring guide extending outwardly from the moveable plate in the vertical direction.

13. The system of claim 11, wherein the proximity range R1 extends outwardly from the sensor by 0.6 to 1inch.

14. The system of claim 11, wherein the proximity element is integral with a lid of the container.

15. The autofill system of claim 11, wherein the base unit further comprises:

a circumferential sidewall extending outwardly from the recessed wall in the vertical direction and together defining an opening, the circumferential sidewall having a threaded portion along an inner surface of the circumferential sidewall;

the spring adjuster having a threaded adjuster portion in threaded engagement with the threaded portion of the circumferential sidewall coupling the spring adjuster with the recessed wall; and wherein the liquid fill level is adjustable by rotating the spring adjuster to tension the spring.

16. The autofill system of claim 11, wherein the spring adjuster further comprising:

an adjuster bottom;

adjuster sidewalls extending between an adjuster bottom portion and an adjuster top portion along the vertical direction and connected with the adjuster bottom at the adjuster bottom portion;

a circumferential stop extending circumferentially outward in a lateral direction from the adjuster sidewalls along the adjuster top portion.

* * * * *